US006432219B1

(12) United States Patent
Wijngaard et al.

(10) Patent No.: US 6,432,219 B1
(45) Date of Patent: Aug. 13, 2002

(54) METHOD FOR SEPARATING LAYERS FROM ARTICLES

(75) Inventors: Jan Hendrik Wijngaard, Chur; Hans Braendle, Sargans, both of (CH)

(73) Assignee: Unakis Trading AG, Trubbach (CH)

( * ) Notice: Subject to any disclaimer, the term of this patent is extended or adjusted under 35 U.S.C. 154(b) by 0 days.

(21) Appl. No.: 09/530,460

(22) PCT Filed: Nov. 9, 1998

(86) PCT No.: PCT/CH98/00479

§ 371 (c)(1),
(2), (4) Date: Apr. 24, 2000

(87) PCT Pub. No.: WO99/24642

PCT Pub. Date: May 20, 1999

(30) Foreign Application Priority Data

Nov. 10, 1997 (CH) ..... 2588/97
Jul. 1, 1998 (CH) ..... 1403/98

(51) Int. Cl.[7] ..... C23G 1/14

(52) U.S. Cl. ..... 134/41; 134/2; 134/3; 134/28; 216/83; 216/100; 216/102; 216/103

(58) Field of Search ..... 134/2, 3, 28, 41; 216/83, 100, 102, 103

(56) References Cited

U.S. PATENT DOCUMENTS

| | | | | |
|---|---|---|---|---|
| 3,854,996 A | | 12/1974 | Frost et al. | |
| 4,666,528 A | | 5/1987 | Arrington et al. | |
| 5,847,463 A | * | 12/1998 | Trivedi et al. | 257/751 |
| 5,981,380 A | * | 11/1999 | Trivedi et al. | 438/639 |

FOREIGN PATENT DOCUMENTS

| | | | |
|---|---|---|---|
| DE | 4101843 | 1/1991 | C23F/1/32 |
| DE | 4110595 | 4/1991 | C23F/1/14 |
| DE | 4339502 | 11/1993 | C23F/1/14 |
| EP | 0831136 | 3/1998 | C09G/1/02 |
| WO | 9207110 | 4/1992 | C23G/1/19 |

OTHER PUBLICATIONS

Patent Abstracts of Japan, "Titanium Coating Film Remover for High–Speed Tool Steel", Publication No. 05112885, May 7, 1993.

* cited by examiner

*Primary Examiner*—Randy Gulakowski
*Assistant Examiner*—Jiri Smetana
(74) *Attorney, Agent, or Firm*—Notaro & Michalos P.C.

(57) ABSTRACT

A method for separating layers from articles made of high-speed steel and having at least one layer of TiAlN, includes applying an alkaline solution containing hydrogen peroxide, a base as well as acid to the layer. The acid is selected from phosphates, phosphonates and phosphonic acids.

28 Claims, No Drawings

METHOD FOR SEPARATING LAYERS FROM ARTICLES

This is a national stage of PCT Application No. PCT/CH98/00479, filed Nov. 9, 1998, and now pending.

FIELD AND BACKGROUND OF THE INVENTION

The present invention relates to a method for separating layers from articles provided with a hard material layer comprising a Ti compound, in an alkaline solution comprising hydrogen peroxide at least one base at least one acid and/or a salt of an acid.

DD 228 977 describes a method for separating of TiN layers, in particular for separating TiN layers applied onto nickel substrates. The articles to be treated are therein placed into a hydrogen peroxide solution with a content of 35 Ma % peroxide for approximately 3 minutes at a temperature of approximately 70° C. to 80° C., subsequently rinsed in water, dried and then mull-wiped off. For the separating of TiAlN layers, this method is unsuitable, since TiAlN is poorly soluble in hydrogen peroxide solution.

According to GB 2 127 042 titanium nitride hard material layers on substrates of stainless steel are separated in aqueous nitric acid at temperatures above 70° C. The layer separation time for a 1 $\mu$m thick layer at 70° C. is approximately 50 hours. This extremely long layer separation time is of great disadvantage.

A method for the layer separation of hard material layers on different metal substrates is known from U.S. Pat. No. 4,746,369. The acidic layer separation bath is composed of hydrogen peroxide as oxidant and a phosphoric acid or nitric acid. Further, different surface-active materials are used. The very low pH value of the solution of less than 0.5 is of disadvantage for the application on high-speed steel-substrate-HSS (High Speed Steel).

DE 41 10 595 proposes to carry out hard material layer [separation] from tool surfaces in a hydrogen peroxide solution stabilized by complexing agents with potassium sodium tartrate ttrahydrate or sodium gluconate being used as the complexing agent. On the one hand, TiAlN layers are thereby not separated at a satisfactory rate and, on the other hand, the stabilizers used exhibit only a conditionally stabilizing effect.

From DE 41 01 843 a method is known for the layer separating of objects layered with hard material layers, wherein the objects are treated with a solution comprising tetrasodium diphosphate and hydrogen peroxide. Typical are hydrogen peroxide concentrations of 8 to 12%, the relatively high tetrasodium diphosphate concentration of 8 to 12%, high process temperature at boiling temperature, and high pH values of 8 to 12. If the solution is concentrated by evaporation—which occurs relatively rapidly at the high temperatures—phosphatization of the already delayered surface can occur. Titanium nitride and/or titanium nitride/carbide hard material layers are separated.

Lastly, from DE 43 39 502 methods are known which are specific to the layer material, for the layer separating of metal substrates, in particular also of hard metal substrates, which comprise hard material layers comprised of either TiN, TiCN or TiAlN or of layer systems comprising TiN/TiAlN.

Therein an alkaline solution with hydrogen peroxide, at least one base as well as at least one salt of mono- and dicarboxylic acids is used.

Depending on the layer to be separated, and while protecting the substrate, the solution bath is composed of a multiplicity of components, specific to the layer material.

SUMMARY OF THE INVENTION

Building on the last-cited method specific to the layer material, it is the task of the present invention to propose a method with which significantly simpler and more flexibly large-scale industrial high-speed steel substrates can be delayered, and specifically independently of whether or not they are layered with a TiN, a TiCN and/or a TiAlN hard material layer. In contrast to the above described method, according to the invention one and the same method becomes possible for the separation of all cited hard material layers from HSS substrates.

Definitions

1) High-Speed Steel

A high-speed steel is characterized by high carbon concentrations of up to 1.5%, and additions of strongly carbide-forming elements such as chromium, molybdenum, tungsten and vanadium. Up to 12% of cobalt is comprised in some of the more complex grades.

This steel is referred to as high-speed steel because it retains its high hardness at high-speed applications (see D. T. Llewellyn, Steel: Metallurgy and Application, Butterworth-Heihemann Ltd., Oxford 1992, p. 174).

2) Phosphate

As a phosphate is defined a salt of a phosphoric acid, diphosphoric acid, triphosphoric acid, etc. For example, the phosphate "calcium phosphate" is a salt of phosphoric acid, "disodium dihydrogen phosphate" is a salt of diphosphoric acid, further "pentasodium triphosphate" is a salt of triphosphoric acid.

3) Phosphonate

By a phosphonate is understood a salt of a phosphonic acid, in particular of an organic phosphonic acid, i.e. of a phosphonic acid with organic substituents.

The posed task is solved thereby that for the layer separation of HSS substrates with at least one layer comprising TiN, TiCN or TiAlN, at least one substance from the group of phophates, phosphonates and phosphonic acids is used.

Preferably the following specific method guidances are used alternatively or in combination:

the phosphate disodium dihydrogen pyrophosphate, $Na_2H_2P_2O_7$ and/or pentasodium triphosphate ($Na_5P_3O_{10}$) are preferably used;

as the phosphonic acid is preferably used aminotri (methylene phosphonic acid) and/or 1-hydroxyethane (1, 1-diphosphonic acid). These phosphonic acids are added to the solution as such. This applies generally to the use of phosphonates, phosphates and phosphonic acids.

It has been found, at least preliminarily, that the use of 1-hydroxy ethane(1, 1-diphosphonic acid) is especially suitable.

The process temperature of the solution bath is maintained at 20° C. to 80° C. (the range limits are included), if appropriate by heating and/or cooling;

The peroxide concentration is s elected between 5 and 50 wt. % (the range limits are included);

The concentration of phosphate and/or phosphonate and/or phosphonic acid is selected between 0.1 and 10 wt. % (the range limits are included);

Relatively large solution bath volumes, for example ≧50 l or even ≧100 1 can also be stably operated;

The solution comprises preferably distilled water, hydrogen peroxide, the cited base, for example NaOH, and the cited phosphates and/or phosphonates and/or phosphonic acids, at least by a far predominant fraction.

This permits circumventing a layer material-specific and complex solution composition and the feasibility is created of separating layers of each of the listed hard material layers from HSS substrates with the same solution. Furthermore, the extremely high apparatus expenditure is dispensed with, which must be expended if an alkaline hydrogen peroxide bath with a pH value of 8 to 12 is operated in the boiling temperature range. Due to the low process temperature at which the solution bath according to the invention can be operated, the danger of phosphatization is also absent, which exists at high process temperatures in the boiling temperature range due to rapid concentration through evaporation.

This offers the capability for economic and large-scale industrial layer separation to operate stably delayering baths with large volumes, for example of more than 50 l or even of more than 100 l . Therewith large quantities of hard-material layered HSS substrates, such as for example tools, can be delayered within a few hours.

In contrast to TiN and TiCN, TiAlN does not dissolve in hydrogen peroxide solutions even at increased temperatures. If the pH value of the hydrogen peroxide solution is raised by adding a base, such as NaOH, into the alkaline range with a pH≧7, in addition to the cited TiN and TiCN layers, TiAlN layers are also dissolved. It was found according to the invention that this is also the case at low process temperatures.

An advantage of the alkaline hydrogen peroxide is the high process certainty with respect to corrosion of HSS material. In an alkaline medium HSS is highly inert. Thus, no corrosion danger for the HSS substrate exists even if relatively long layer separation times would have to be used.

The problem of instability of alkaline hydrogen peroxide solutions, in that an autooxidation of the hydrogen peroxide occurs which is catalyzed by metal ions which are released into the solution during the delayering process, which in turn leads to overheating and boiling-up of the delayering bath, is solved according to the invention through the addition of at least one phosphate and/or phosphonate and/or at least one phosphonic acid as stabilizer. Through this addition the layer separating is furthermore accelerated, and specifically with respect to all cited hard material layers. Through this addition the bath stability is improved such that the layer separation bath could be stably operated even at increased temperature. For maintaining the bath temperature, a heating and/or cooling system can be provided; if appropriate the bath temperature is regulated to a nominal value, with the heating and/or cooling system as the correcting element.

DESCRIPTION THE PREFERRED EMBODIMENTS

Regarding the differences in efficacy of phosphates and/or phosphonates and/or of phosphonic acid in the solution used according to the invention:

When using phosphate alone the bath service life is relatively modest, in the normal case it is between 1 and 3 charges, which, it is understood, is quite sufficient in certain cases. This relatively modest bath service life is due to the restricted stability of polyphosphates. The stability of polyphosphates in alkaline solutions is only moderate, in acidic solutions it is poor. Through hydrolysis the polyphosphates are converted to orthophosphates which are far less effective for the stabilization of the peroxide solutions.

In the case of organic phosphonates and phosphonic acids the behavior is different.

In comparison to the inorganic polyphosphates, phosphonates and phosphonic acids have very good hydrolytic stability. This can be traced back to the very high stability of the C—P bonds of the phosphonates and phosphonic acids. In addition to the increased stabilizing effect, increase of the bath service life, phosphonates and phosphonic acids lead, furthermore, to a further acceleration of the layer separation reaction.

EXAMPLE I

The following solution was used as the layer separation bath:

125 l hydrogen peroxide, 17.5 wt. %

1.25 kg $Na_5P_3O_{10}$ 500 g NaOH.

The bath was heated to 60° C. and 500 pieces of 12 mm HSS end-milling cutters, layered with a TiAlN layer, were placed into the solution. The tools were completely delayered after 3 hours and the bath temperature had remained stable at 60±2° C.

EXAMPLE II

The following layer-separation solution was prepared:

125 l hydrogen peroxide, 17.5 wt. %

0.2 mol/l aminotri-(methylene phosphonic acid) ATMP 0.4 mol/l NaOH

The temperature of the layer-separation solution was kept constant at approximately 60° C. through heating/cooling and 500 pieces of 12 mm HSS end-milling cutters layered with a TiAlN layer were placed into the solution. The tools were completely delayered after three hours and the bath temperature had therein stayed stably at 60±2° C. It was possible to separate the layers of the cited charges in the same solution. Compared to the use of polyphosphates according to Example I, the bath service life could be extending by a factor of 2 to 4.

EXAMPLE III

The following layer separation solution was prepared:

125 l hydrogen peroxide, 17.5 wt. %

2 wt. % 1 -hydroxyethane (1,1-diphosphonic acid) HEDP 0.4 mol/l NaOH.

Operated and charged as in Example II, however with shortened delayering times, the same results were obtained as in Example II.

One advantage of the present invention is the simple solution composition, the simple process guidance and the short layer separation time. At solution temperatures markedly below the boiling point, it is possible to obtain already within a few hours the separation of the layers. With respect to corrosion on HSS substrates high certainty exists: no corrosion of HSS takes place since the delayering solution is alkaline.

An essential advantage is further that in the same pass, i.e. with the same layer-separation solution a large number of HSS substrates, for example mixed with TiN, TiCN and/or TiAlN layers, can be delayered inter alia thereby that high volumes of solution, for example of more than 50 l or even of more than 100 l , can be stably operated with low expenditure.

What is claimed is:

1. A method of separating at least one hard material layer from a high-speed steel substrate of an article, comprising:

providing an article having at least one hard material layer comprising TiAlN; and exposing the article to an alkaline solution containing hydrogen peroxide, at least one base, and at least one of an acid and of a salt of an acid, the at least one of said acid and of said salt of an acid comprising at least one substance selected from the group consisting of phosphates, phosphonates, and phosphonic acids.

2. A method as claimed in claim 1, including adding phosphonate to the solution to provide the at least one acid.

3. A method as claimed in claim 1, including adding an organic phosphonic acid to the solution o provide the at least one acid.

4. A method as claimed in claim 1, wherein the at least one acid is selected from the group consisting of: phosphonic acid, aminotri-(methylene phosphonic acid) and 1-hydroxyethane(1,1-diphosphonic acid).

5. A method as claimed in claim 1, wherein the phosphate is at least one of disodium dihydrogenpyrophosphate and $Na_2H_2P_2O_7$ and pentasodium triphosphate ($Na_5P_3O_{10}$).

6. A method as claimed in claim 1, including maintaining the solution at a temperature of about between 20° C. and 80° C.

7. A method as claimed in claim 1, wherein the hydrogen peroxide has a concentration of between about 5 and 50 wt. %.

8. A method as claimed in claim 1, wherein the concentration of at least one of phosphate and phosphonate and phosphonic acid is between about 0.1 and 10 wt. %.

9. A method as claimed in claim 1, wherein a solution volume of at least 50 l is used.

10. A method as claimed in claim 1, herein a solution volume of at least 100 l is used.

11. A method as claimed in claim 1, wherein, simultaneously, in addition to at least one TiAlN layer, at least one of a TiN and a TiCN layer is separated from the article.

12. A method as claimed in claim 1, wherein the layer is separated from a tool which comprises the article.

13. A method as claimed in claim 12, wherein the layer is separated from a cutting or forming tool.

14. A method as claimed in claim 13, wherein the layer is separated from an end-milling cutter, an indexable insert or a stamping tool.

15. A method for manufacturing a high-speed steel substrate of an article, comprising:

providing an article having at least one hard material layer comprising TiAlN; and exposing the article to an alkaline solution containing hydrogen peroxide, at least one base, and at least one of an acid and of a salt of an acid, the at least one of said acid and of said salt of an acid comprising at least one substance selected from the group consisting of phosphates, phosphonates, and phosphonic acids.

16. A method as claimed in claim 15, including adding phosphonate to the solution to provide the at least one acid.

17. A method as claimed in claim 15, including adding an organic phosphonic acid to the solution to provide the at least one acid.

18. A method as claimed in claim 15, wherein the at least one acid is selected from the group consisting of: phosphonic acid, aminotri-(methylene phosphonic acid) and 1-hydroxyethane(1, 1-diphosphonic acid).

19. A method as claimed in claim 15, wherein the phosphate is at least one of disodium dihydrogenpyrophosphate and $Na_2H_2P_2O_7$ and pentasodium triphosphate ($Na_5P_3O_{10}$).

20. A method as claimed in claim 15, including maintaining the solution at a temperature of about between 20° C. and 80° C.

21. A method as claimed in claim 15, wherein the hydrogen peroxide has a concentration of between about 5 and 50 wt. %.

22. A method as claimed in claim 15, wherein the concentration of at least one of phosphate and phosphonate and phosphonic acid is between about 0.1 and 10 wt. %.

23. A method as claimed in claim 15, wherein a solution volume of at least 50 1 is used.

24. A method as claimed in claim 15, wherein a solution volume of at least 100 1 is used.

25. A method as claimed in claim 15, wherein, simultaneously, in addition to at least one TiAlN layer, at least one of a TiN and a TiCN layer is separated from the article.

26. A method as claimed in claim 15, wherein the layer is separated from a tool which comprises the article.

27. A method as claimed in claim 26, wherein the layer is separated from a cutting or forming tool.

28. A method as claimed in claim 27, wherein the layer is separated from an end-milling cutter, an indexable insert or a stamping tool.

* * * * *

UNITED STATES PATENT AND TRADEMARK OFFICE

CERTIFICATE OF CORRECTION

PATENT NO. : 6,432,219 B1
DATED : August 13, 2002
INVENTOR(S) : J.H. Wijngaard et al.

It is certified that error appears in the above-identified patent and that said Letters Patent is hereby corrected as shown below:

Title page,
Item [73], Assignee, please change the name of the Assignee from "Unakis Trading AG" to -- Unaxis Trading AG --.

Signed and Sealed this

Twenty-eighth Day of January, 2003

JAMES E. ROGAN
*Director of the United States Patent and Trademark Office*